US010559871B2

(12) United States Patent
Chen et al.

(10) Patent No.: US 10,559,871 B2
(45) Date of Patent: Feb. 11, 2020

(54) ANTENNA STRUCTURE AND WIRELESS COMMUNICATION DEVICE USING SAME

(71) Applicant: Chiun Mai Communication Systems, Inc., New Taipei (TW)

(72) Inventors: Chang-Je Chen, New Taipei (TW); Shu-Cheng Lu, New Taipei (TW); Yi-Ting Chen, New Taipei (TW); Yen-Jung Tseng, New Taipei (TW); Yi-Te Chou, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 208 days.

(21) Appl. No.: 15/870,884

(22) Filed: Jan. 13, 2018

(65) Prior Publication Data

US 2018/0248264 A1 Aug. 30, 2018

Related U.S. Application Data

(60) Provisional application No. 62/462,941, filed on Feb. 24, 2017.

(30) Foreign Application Priority Data

Nov. 15, 2017 (CN) ..... 2017 1 1133054

(51) Int. Cl.
*H01Q 1/24* (2006.01)
*H01Q 21/28* (2006.01)
*H01Q 5/378* (2015.01)

(52) U.S. Cl.
CPC ..... *H01Q 1/243* (2013.01); *H01Q 5/378* (2015.01); *H01Q 21/28* (2013.01)

(58) Field of Classification Search
CPC ..... H01Q 1/243; H01Q 13/16; H01Q 5/35
See application file for complete search history.

(56) References Cited

U.S. PATENT DOCUMENTS

| | | | | |
|---|---|---|---|---|
| 9,484,631 | B1 | 11/2016 | Napoles et al. | |
| 2012/0112970 | A1 | 5/2012 | Caballero et al. | |
| 2016/0344439 | A1* | 11/2016 | Seol | H01Q 1/243 |
| 2017/0201010 | A1* | 7/2017 | Kim | H01Q 9/42 |
| 2017/0338545 | A1* | 11/2017 | Guo | H01Q 1/243 |
| 2018/0026346 | A1 | 1/2018 | Lee et al. | |

FOREIGN PATENT DOCUMENTS

| | | | |
|---|---|---|---|
| CN | 104347931 | A | 2/2015 |
| CN | 105762515 | A | 7/2016 |
| CN | 205960191 | U | 2/2017 |
| EP | 3104454 | A1 | 12/2016 |
| GB | 2529885 | A | 3/2016 |

* cited by examiner

*Primary Examiner* — Robert Karacsony
(74) *Attorney, Agent, or Firm* — ScienBiziP, P.C.

(57) ABSTRACT

An antenna structure includes a housing, four feed sources, a first radiator, a second radiator, and a third radiator. The housing includes a first radiating portion and a second radiating portion. The first to third radiators are positioned in the housing. The first radiator is spaced apart from the second radiator. The four feed sources respectively connect to the first radiating portion, the second radiating portion, the first radiator, and the third radiator. The first radiating portion activates a first operation mode and a second operation mode. The second radiating portion activates a third operation mode. The first to third radiators activate a fourth operation mode, a fifth operation mode, and a sixth operation mode.

20 Claims, 14 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201711133054.5 filed on Nov. 15, 2017, and claims priority to U.S. Patent Application No. 62/462,941 filed on Feb. 24, 2017, the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as signals in Long Term Evolution Advanced (LTE-A) frequency bands. However, when the antenna is located in the metal housing, the antenna signals are often shielded by the metal housing. This can degrade the operation of the wireless communication device. Additionally, the metallic backboard generally defines slots or/and gaps thereon, which will affect an integrity and an aesthetic quality of the metallic backboard.

BRIEF DESCRIPTION OF THE DRAWINGS

Implementations of the present technology will now be described, by way of example only, with reference to the attached figures.

DETAILED DESCRIPTION

Figure 1:
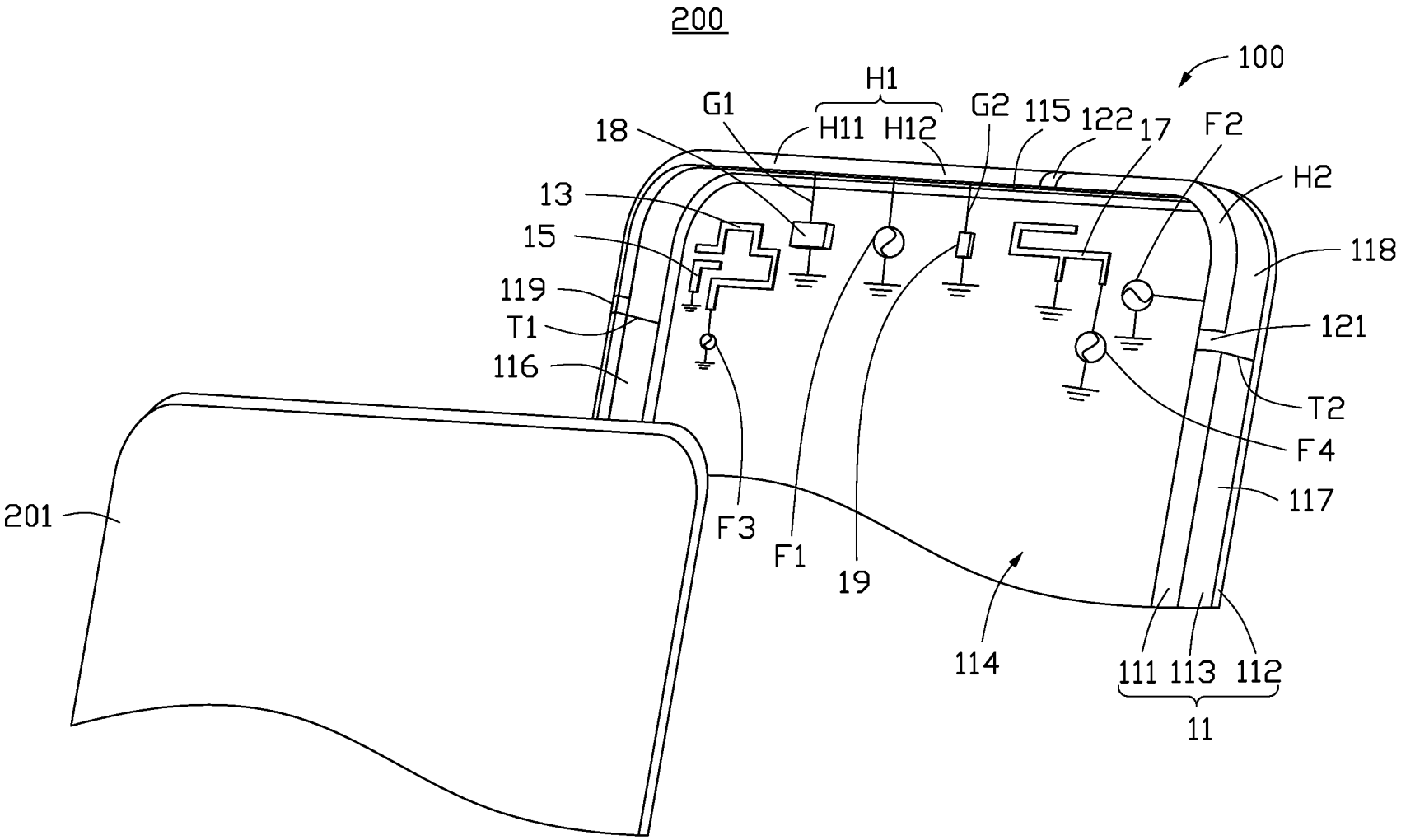
FIG. 1 is an isometric view of an exemplary embodiment of a wireless communication device using an exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a wireless communication device 200 using an exemplary antenna structure 100. The wireless communication device 200 can be a mobile phone or a personal digital assistant, for example. The antenna structure 100 can receive and send wireless signals.

Figure 2:
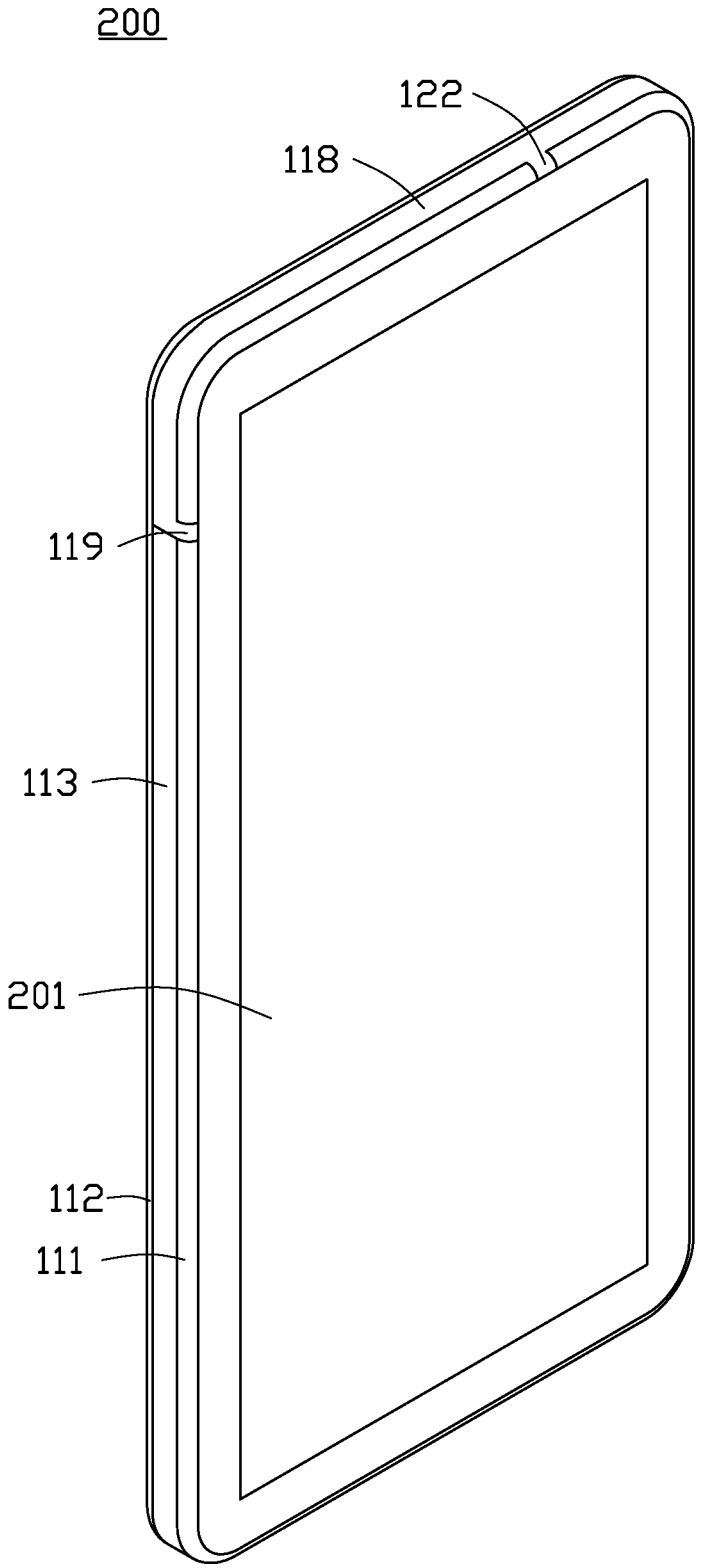
FIG. 2 is an assembled, isometric view of the wireless communication device of FIG. 1.
Figure 3:
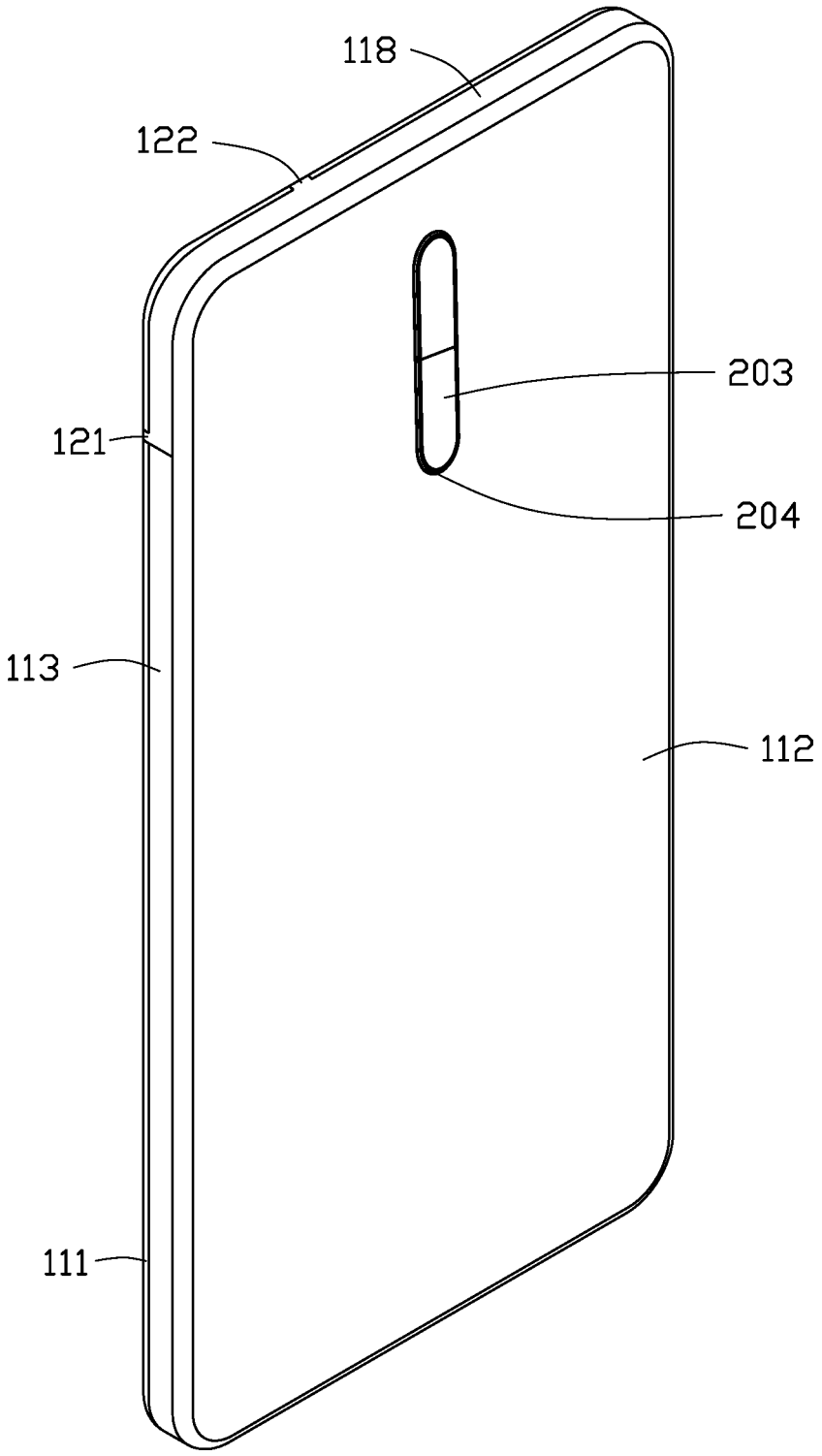
FIG. 3 is similar to FIG. 2, but shown from another angle.

As illustrated in FIG. 2 and FIG. 3, the antenna structure 100 includes a housing 11, a first feed source F1, a second feed source F2, a third feed source F3, a fourth feed source F4, a first ground portion G1, a second ground portion G2, a first radiator 13, a second radiator 15, and a third radiator 17.

The housing 11 can be a metal housing of the wireless communication device 200. In this exemplary embodiment, the housing 11 is made of metallic material. The housing 11 includes a front frame 111, a backboard 112, and a side frame 113. The front frame 111, the backboard 112, and the side frame 113 can be integral with each other. The front frame 111, the backboard 112, and the side frame 113 cooperatively form the housing of the wireless communication device 200.

The front frame 111 defines an opening (not shown). The wireless communication device 200 includes a display 201. The display 201 is received in the opening. The display 201 has a display surface. The display surface is exposed at the opening and is positioned parallel to the backboard 112.

The backboard 112 is positioned opposite to the front frame 111. The backboard 112 is directly connected to the side frame 113 and there is no gap between the backboard 112 and the side frame 113. In this exemplary embodiment, the backboard 112 is an integral and single metallic sheet. Except for a hole 204 exposing a camera lens 203, the backboard 112 does not define any other slot, break line, and/or gap. The backboard 112 serves as the ground of the antenna structure 100.

The side frame 113 is positioned between the backboard 112 and the front frame 111. The side frame 113 is positioned around a periphery of the backboard 112 and a periphery of the front frame 111. The side frame 113 forms a receiving space 114 together with the display 201, the front frame 111, and the backboard 112. The receiving space 114 can receive a printed circuit board, a processing unit, or other electronic components or modules.

The side frame 113 includes an end portion 115, a first side portion 116, and a second side portion 117. In this exemplary embodiment, the end portion 115 can be a top portion of the wireless communication device 200. The end portion 115 connects the front frame 111 and the backboard 112. The first side portion 116 is positioned apart from and parallel to the second side portion 117. The end portion 115 has first and second ends. The first side portion 116 is connected to the first end of the first frame 111 and the second side portion 117 is connected to the second end of the end portion 115. The first side portion 116 and the second side portion 117 both connect to the front frame 111 and the backboard 112.

The side frame 113 defines a slot 118. The front frame 111 defines a first gap 119, a second gap 121, and a groove 122. In this exemplary embodiment, the slot 118 is defined at the end portion 115 and extends to the first side portion 116 and the second portion 117.

The first gap 119, the second gap 121, and the groove 122 all communicate with the slot 118 and extend across the front frame 111. In this exemplary embodiment, the first gap 119 is defined on the front frame 111 and communicates with a first end T1 of the slot 118 positioned on the first side portion 116. The second gap 121 is defined on the front frame 111 and communicates with a second end T2 of the slot 118 positioned on the second side portion 117. The groove 122 is positioned on the end portion 115. The groove 122 is positioned between the first end T1 and the second end T2, and communicates with the slot 118.

Two portions are divided from the housing 11 by the slot 118, the first gap 119, the second gap 121, and the groove 122. The two portions are a first radiating portion H1 and a second radiating portion H2. A first portion of the front frame 111 between the first gap 119 and the groove 122 forms the first radiating portion H1. A second portion of the front frame 111 between the second gap 121 and the groove 122 forms the second radiating portion H2. In this exemplary embodiment, the groove 122 is not positioned at a middle portion of the end portion 115. The first radiating portion H1 is longer than the second radiating portion H2.

In this exemplary embodiment, the slot 118, the first gap 119, the second gap 121, and the groove 122 are all filled with insulating material, for example, plastic, rubber, glass, wood, ceramic, or the like.

In this exemplary embodiment, the slot 118 is defined on the end of the side frame 113 adjacent to the backboard 112 and extends to the front frame 111. Then the first radiating portion H1 and the second radiating portion H2 are fully formed by a portion of the front frame 111. In other exemplary embodiments, a location of the slot 118 can be adjusted. For example, the slot 118 can be defined on the end of the side frame 113 adjacent to the backboard 112 and extends towards the front frame 111. Then the first radiating portion H1 and the second radiating portion H2 are formed by a portion of the front frame 111 and a portion of the side frame 113.

In other exemplary embodiments, the slot 118 is defined only at the end portion 115 and does not extend to any one of the first side portion 116 and the second portion 117. In other exemplary embodiments, the slot 118 can be defined at the end portion 115 and extend to one of the first side portion 116 and the second portion 117. Then, locations of the first end T1 and the second end T2 and locations of the first gap 119 and the second gap 121 can be adjusted according to a position of the slot 118. For example, one of the first end T1 and the second end T2 can be positioned at a location of the front frame 111 corresponding to the end portion 115. The other one of the first end T1 and the second end T2 is positioned at a location of the front frame 111 corresponding to the first side portion 116 or the second side portion 117. That is, a shape and a location of the slot 118, locations of the first end T1 and the second end T2 on the side frame 113 can be adjusted, to ensure that the first radiating portion H1 and the second radiating portion H2 can be divided from the housing 11 by the slot 118, the first gap 119, the second gap 121, and the groove 122.

In this exemplary embodiment, except for the slot 118, the first gap 119, the second gap 121, and the groove 122, an upper half portion of the front frame 111 and the side frame 113 does not define any other slot, break line, and/or gap.

Figure 4:
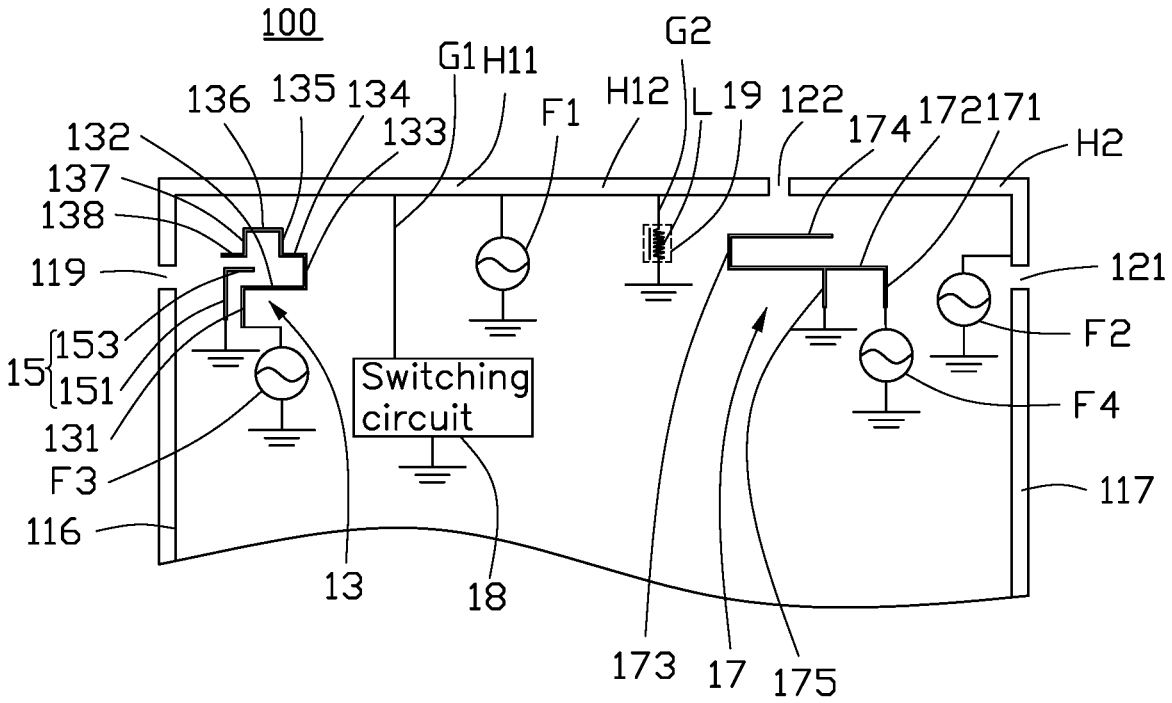
FIG. 4 is a circuit diagram of the antenna structure of FIG. 1.

As illustrated in FIG. 4, the first feed source F1 is positioned inside of the receiving space 114. One end of the first feed source F1 is electrically connected to the first radiating portion F1 to feed current to the first radiating portion F1. Another end of the first feed source F1 is electrically connected to the backboard 112 to be grounded. In this exemplary embodiment, when the first feed source F1 supplies current, the current flows to the first radiating portion H1 and respectively transmits to the first gap 119 and the groove 122. Then the first radiating portion H1 is divided by the first feed source F1 into a first branch H11 towards the first gap 119 and a second branch H12 towards the groove 122. A first portion of the front frame 111 extending from the first feed source F1 to the first gap 119 forms the first branch H11. A second portion of the front frame 111 extending from the first feed source F1 to the groove 122 forms the second branch H12.

The first ground portion G1 is positioned in the receiving space 114 between the first side portion 116 and the first feed source F1. One end of the first ground portion G1 is electrically connected to the first branch H11. Another end of the first ground portion G1 is electrically connected to the backboard 112 for grounding the first branch H11.

The second ground portion G2 is positioned in the receiving space 114 between the groove 122 and the first feed source F1. One end of the second ground portion G2 is electrically connected to the second branch H12. Another end of the second ground portion G2 is electrically connected to the backboard 112 for grounding the second branch H12.

In this exemplary embodiment, the first feed source F1, the first branch H11, and the first ground portion G1 cooperatively form a first inverted-F antenna to activate a first operation mode for generating radiation signals in a first frequency band. The first feed source F1, the second branch H12, and the second ground portion G2 cooperatively form a second inverted-F antenna to activate a second operation mode for generating radiation signals in a second frequency band. In this exemplary embodiment, the first operation mode is a Long Term Evolution Advanced (LTE-A) low frequency operation mode. The second operation mode is an LTE-A middle frequency operation mode. Frequencies of the second frequency band are higher than frequencies of the first frequency band. In this exemplary embodiment, the first frequency band is a frequency band of about 703-960 MHz. The second frequency band is a frequency band of about 1710-2170 MHz.

The second feed source F2 is positioned in the receiving space 114 adjacent to the second gap 121. One end of the second feed source F2 is electrically connected to one end of the second radiating portion H2 adjacent to the second gap 121, to feed current to the second radiating portion H2. Another end of the second feed source F2 is electrically connected to the backboard 112 to be grounded.

In this exemplary embodiment, the second feed source F2 and the second radiating portion H2 cooperatively form a monopole antenna to activate a third operation mode for generating radiation signals in a third frequency band. The third operation mode is a GPS operation mode. Frequencies of the third frequency band are higher than frequencies of the first frequency band and less than frequencies of the second frequency band. In this exemplary embodiment, the third frequency band has a central frequency of about 1575 MHz.

As illustrated in FIG. 4, the first radiator 13 is positioned in the receiving space 114 between the first ground portion G1 and the first side portion 116. The first radiator 13 includes a first radiating arm 131, a second radiating arm 132, a third radiating arm 133, a fourth radiating arm 134, a fifth radiating arm 135, a sixth radiating arm 136, a seventh radiating arm 137, and an eighth radiating arm 138 connected in that order.

The first radiating arm 131 is substantially rectangular and is positioned parallel to the first side portion 116. The second radiating arm 132 is substantially rectangular. One end of the second radiating arm 132 is perpendicularly connected to one end of the first radiating arm 131 adjacent to the end portion 115. Another end of the second radiating arm 132 extends along a direction parallel to the end portion 115 and towards the second side portion 117. The third radiating arm 133 is substantially rectangular. One end of the third radiating arm 133 is perpendicularly connected to one end of the second radiating arm 132 away from the first radiating arm 131. Another end of the third radiating arm 133 extends along a direction parallel to the first side portion 116 and towards the end portion 115. In this exemplary embodiment, the first radiating arm 131 and the third radiating arm 133 are positioned at two ends of the second radiating arm 132 and extend along two opposite directions.

The fourth radiating arm 134 is substantially rectangular. One end of the fourth radiating arm 134 is perpendicularly connected to one end of the third radiating arm 133 away from the second radiating arm 132. Another end of the fourth radiating arm 134 extends along a direction parallel to the end portion 115 and towards the first side portion 116. The second radiating arm 132 and the fourth radiating arm 134 are positioned at the same side of the third radiating arm 133 and form a U-shaped structure with the third radiating arm 133. The fifth radiating arm 135 is substantially rectangular. One end of the fifth radiating arm 135 is perpendicularly connected to one end of the fourth radiating arm 134 away from the third radiating arm 133. Another end of the fifth radiating arm 135 extends along a direction parallel to the first side portion 116 and towards the end portion 115.

The sixth radiating arm 136 is substantially rectangular. One end of the sixth radiating arm 136 is perpendicularly connected to one end of the fifth radiating arm 135 away from the fourth radiating arm 134. Another end of the sixth radiating arm 136 extends along a direction parallel to the end portion 115 and towards the first side portion 116. The seventh radiating arm 137 is substantially rectangular. One end of the seventh radiating arm 137 is perpendicularly connected to one end of the sixth radiating arm 136 away from the fifth radiating arm 135. Another end of the seventh radiating arm 136 extends along a direction parallel to the end portion 115 and towards the first side portion 116. The seventh radiating arm 137 is substantially rectangular. One end of the seventh radiating arm 137 is perpendicularly connected to one end of the sixth radiating arm 136 away from the fifth radiating arm 135. Another end of the seventh radiating arm 137 extends along a direction parallel to the first side portion 116 and away from the end portion 115. The fifth radiating arm 135 and the seventh radiating arm 137 are positioned at the same side of the sixth radiating arm 136 and form a U-shaped structure with the sixth radiating arm 136.

The eighth radiating arm 138 is substantially rectangular. One end of the eighth radiating arm 138 is perpendicularly connected to one end of the seventh radiating arm 137 away from the sixth radiating arm 136. Another end of the eighth radiating arm 138 extends along a direction parallel to the end portion 115 and towards the first side portion 116.

The third feed source F3 is positioned in the receiving space 114 adjacent to the first gap 119. One end of the third feed source F3 is electrically connected to one end of the first radiating arm 131 away from the second radiating arm 132, to feed current to the first radiator 13. Another end of the third feed source F3 is electrically connected to the backboard 112 to be grounded.

In this exemplary embodiment, the third feed source F3 and the first radiator 13 cooperatively form a monopole antenna to activate a fourth operation mode for generating radiation signals in a fourth frequency band. The fourth operation mode is a WIFI 2.4 GHz operation mode. The fourth frequency band is a frequency band of about WIFI 2.4 GHz (2400-2480 MHz).

The second radiator 15 is positioned in the receiving space 114 between the first radiator 13 and the first side portion 116. The second radiator 15 includes a first parasitic section 151 and a second parasitic section 153. The first parasitic section 151 is substantially rectangular. One end of the first parasitic section 151 is electrically connected to the backboard 112 to be grounded. Another end of the first parasitic section 151 extends along a direction parallel to the first side portion 116 and towards the eighth radiating arm 138. The second parasitic section 153 is substantially rectangular. One end of the second parasitic section 153 is perpendicularly connected to one end of the first parasitic section 151 towards the eighth radiating arm 138. Another end of the second parasitic section 153 extends along a direction parallel to the eighth radiating arm 138 and towards the third radiating arm 133. The extension continues until the second parasitic section 153 extends into a space surrounded by the first radiator 13.

In this exemplary embodiment, the second radiator 15 is spaced apart from the first radiator 13. The first radiator 13 and the second radiator 15 cooperatively form a coupling-feed-in antenna to activate a fifth operation mode for generating radiation signals in a fifth frequency band. The fifth operation mode is a WIFI 5 GHz operation mode. The fifth frequency band is a frequency band of about WIFI 5 GHz (5150-5850 MHz).

The third radiator 17 is positioned in the receiving space 114 between the second ground portion G2 and the second side portion 117. The third radiator 17 is positioned adjacent to the second side portion 17. The third radiator 17 is a meander sheet. The third radiator 17 includes a feed section 171, a first connecting section 172, a second connecting section 173, a third connecting section 174, and a ground section 175.

The feed section 171 is substantially rectangular. The feed section 171 is positioned parallel to and spaced apart from the second side portion 117. The feed section 171 extends towards the end portion 115. The first connecting section 172 is substantially rectangular. One end of the first connecting section 172 is perpendicularly connected to one end of the feed section 171 adjacent to the end portion 115. Another end of the first connecting section 172 extends along a direction parallel to the end portion 115 and towards the first side portion 116. The extension continues until the first connecting section 172 passes over the groove 122.

The second connecting section 173 is substantially rectangular. One end of the second connecting section 173 is perpendicularly connected to one end of the first connecting section 172 away from the feed section 171. Another end of the second connecting section 173 extends along a direction parallel to the second side portion 117 and towards the end portion 115. In this exemplary embodiment, the second connecting section 173 and the feed section 171 are respectively positioned at two ends of the first connecting section 172 and extend along two opposite directions.

The third connecting section 174 is substantially rectangular. One end of the third connecting section 174 is perpendicularly connected to one end of the second connecting section 173 away from the first connecting section 172. Another end of the third connecting section 174 extends along a direction parallel to the end portion 115 and towards the second side portion 117. The extension continues until the third connecting section 174 passes over the groove 122 and further extends along the direction parallel to the end portion 115 and towards the second side portion 117.

The ground section 175 is substantially rectangular. The ground section 175 is spaced apart from and parallel to the feed section 171. One end of the ground section 175 is perpendicularly connected to one side of the first connecting section 172. Another end of the ground section 175 extends along a direction parallel to the feed section 171 and away from the end portion 115.

The fourth feed source F4 is positioned in the receiving space 114 adjacent to the second gap 121. One end of the fourth feed source F4 is electrically connected to one end of the feed section 171 away from the first connecting section 172, to feed current to the third radiator 17. One end of the fourth feed source F4 is electrically connected to the backboard 112 to be grounded. One end of the ground section 175 away from the first connecting section 172 is electrically connected to the backboard 112 to be grounded, then grounding the third radiator 17.

In this exemplary embodiment, the fourth feed source F4 and the third radiator 17 form a third inverted-F antenna to activate a sixth operation mode for generating radiation signals in a sixth frequency band. In this exemplary embodiment, the sixth operation mode is an LTE-A high frequency operation mode. Frequencies of the sixth frequency band and the fourth frequency band are higher than frequencies of the second frequency band. Frequencies of the sixth frequency band and the fourth frequency band are less than frequencies of the fifth frequency band. The sixth frequency band is a frequency band of about 2300-2690 MHz.

As illustrated in FIG. 1 and FIG. 4, in other exemplary embodiments, the antenna structure 100 further includes a switching circuit 18 for improving a bandwidth of the low frequency band of the first radiating portion H1. The switching circuit 18 is positioned in the receiving space 114. One end of the switching circuit 18 is electrically connected to the first ground portion G1. Then the switching circuit 18 is electrically connected to the first branch H11 of the first radiating portion H1 through the first ground portion G1. Another end of the switching circuit 18 is electrically connected to the backboard 112 to be grounded.

Figure 5:
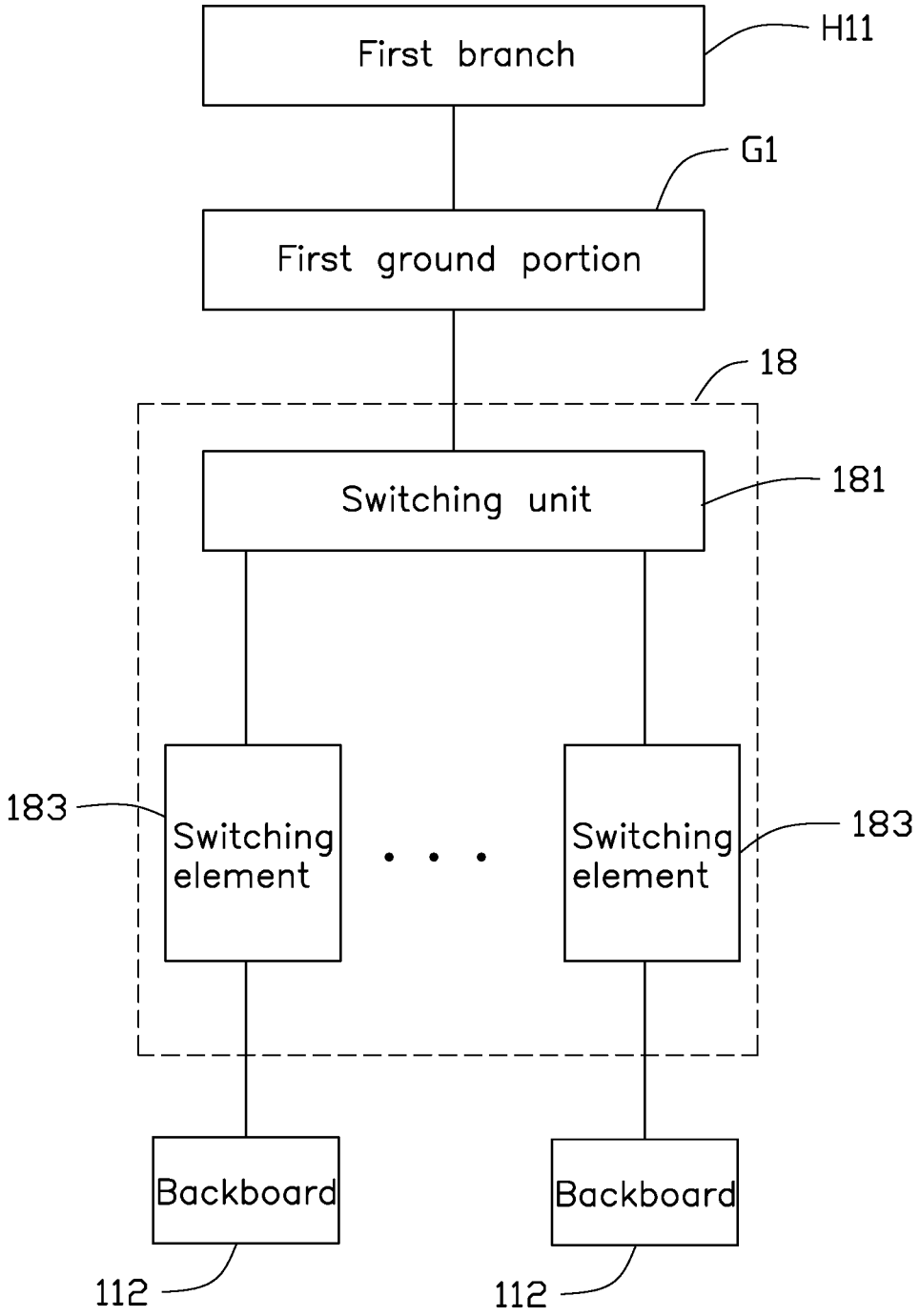
FIG. 5 is a circuit diagram of a switching circuit of the antenna structure of FIG. 4.

As illustrated in FIG. 5, the switching circuit 18 includes a switching unit 181 and a plurality of switching elements 183. The switching unit 181 is electrically connected to the first ground portion G1 and is electrically connected to the first branch H11 of the first radiating portion H1 through the first ground portion G1. The switching elements 183 can be an inductor, a capacitor, or a combination of the inductor and the capacitor. The switching elements 183 are connected in parallel to each other. One end of each switching element 183 is electrically connected to the switching unit 181. The other end of each switching element 183 is electrically grounded to the backboard 112 to be grounded.

Through control of the switching unit 181, the first branch H11 of the first radiating portion E1 can be switched to connect with different switching elements 183. Since each switching element 183 has a different impedance, frequencies of the first frequency band can be adjusted.

For example, in this exemplary embodiment, the switching circuit 18 includes four switching elements 183, which are all inductors and have inductance values of about 27 nH, 15 nH, 9.1 nH, and 6.2 nH. When the switching unit 181 switches to connect with a switching element 183 having an inductance value of about 27 nH, the antenna structure 100 can work at frequency bands of LTE-A Band 17 (704-746 MHz). When the switching unit 181 switches to connect with a switching element 183 having an inductance value of about 15 nH, the antenna structure 100 can work at a frequency band of LTE-A Band 20 (791-862 MHz). When the switching unit 181 switches to connect with a switching element 183 having an inductance value of about 9.1 nH, the antenna structure 100 can work at a frequency band of LTE-A Band 5 (824-894 MHz). When the switching unit 181 switches to connect with a switching element 183 having an inductance value of about 6.2 nH, the antenna structure 100 can work at a frequency band of LTE-A Band 8 (880-960 MHz). That is, through switching the switching unit 181, a low frequency band of the antenna structure 100 can cover 704-960 MHz.

As illustrated in FIG. 1 and FIG. 4, in other exemplary embodiments, the antenna structure 100 further includes a matching circuit 19 for improving a bandwidth of the middle frequency band of the first radiating portion H1. The matching circuit 19 is positioned in the receiving space 114. One end of the matching circuit 19 is electrically connected to the second ground portion G2. Then the matching circuit 19 is electrically connected to the second branch H12 of the first radiating portion H1 through the second ground portion G2. Another end of the matching circuit 19 is electrically connected to the backboard 112 to be grounded.

In this exemplary embodiment, the matching circuit 19 includes an inductor L. One end of the inductor L is electrically connected to the second ground portion G2. Then the inductor L is electrically connected to the second branch H12 of the first radiating portion H1 through the second ground portion G2. Another end of the inductor L is electrically connected to the backboard 112 to be grounded. The inductance L may match or compensate an impedance of the second branch H12. Through adjusting the inductance of the inductor L, frequencies of the middle frequency band of the antenna structure 100 (i.e., the second frequency band) can be effectively adjusted, so that the middle frequency band of the antenna structure 100 can cover 1710-2170 MHz.

Figure 6:
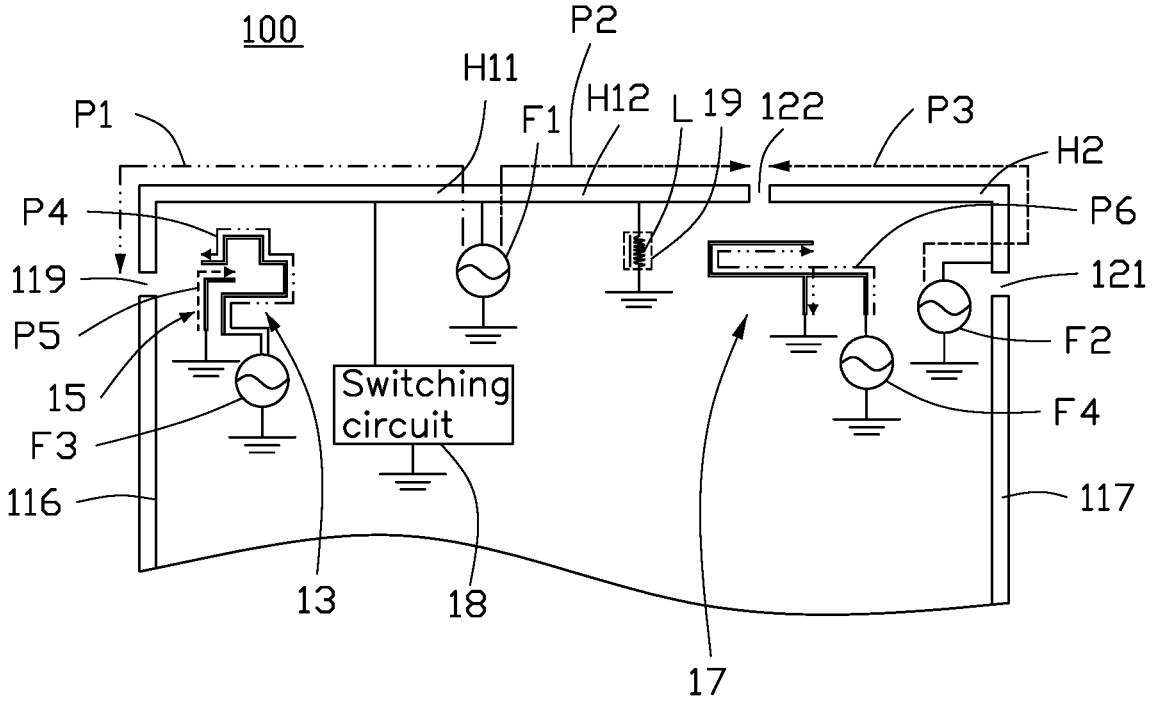
FIG. 6 is a current path distribution graph of the antenna structure of FIG. 4.

As illustrated in FIG. 6, when the first feed source F1 supplies current, a portion of the current flows through the first branch H11 of the first radiating portion H1 and flows towards the first gap 119 to activate the first operation mode for generating radiation signals in the first frequency band (Per path P1). Another portion of the current flows through the second branch H12 of the first radiating portion H1 and flows towards the groove 122 to activate the second operation mode for generating radiation signals in the second frequency band (Per path P2).

When the second feed source F2 supplies current, the current flows through the second radiating portion H2 and flows towards the groove 122 to activate the third operation mode for generating radiation signals in the third frequency band (Per path P3). When the third feed source F3 supplies current, the current flows through the first radiator 13 to activate the fourth operation mode for generating radiation signals in the fourth frequency band (Per path P4). At the same time, the current from the third feed source F3 is further coupled, from the first radiator 13, to the second radiator 15, to activate the fifth operation mode for generating radiation signals in the fifth frequency band (Per path P5). When the fourth feed source F4 supplies current, the current flows through the third radiator 17 and is grounded through the ground section 175 of the third radiator 17 to activate the sixth operation mode for generating radiation signals in the sixth frequency band (Per path P6).

In this exemplary embodiment, the first radiating portion H1 and the third radiator 17 are both diversity antennas. The second radiating portion H2 is a GPS antenna. The first radiator 13 is a WIFI 2.4 GHz antenna. The second radiator 15 is a WIFI 5 GHz antenna.

In this exemplary embodiment, the backboard 112 can serve as the ground of the antenna structure 100 and the wireless communication device 200. In other exemplary embodiments, the wireless communication device 200 further includes a shielding mask or a middle frame (not shown). The shielding mask is positioned at the surface of the display 201 towards the backboard 111 and shields against electromagnetic interference. The middle frame is positioned at the surface of the display 201 towards the backboard 112 and supports the display 201. The shielding mask or the middle frame is made of metallic material. The shielding mask or the middle frame can connect the backboard 112 to serve as the ground of the antenna structure 100 and the wireless communication device 200. In above ground, the backboard 112 can be replaced by the shielding mask or the middle frame. In other exemplary embodiment, a circuit board of the wireless communication device 200 can includes a ground plane. In each ground, the ground plane can replace the backboard 112 to ground the antenna structure 100 and the wireless communication device 200. The ground plane can be electrically connected to the shielding mask, the middle frame, and the backboard 112.

Figure 7:
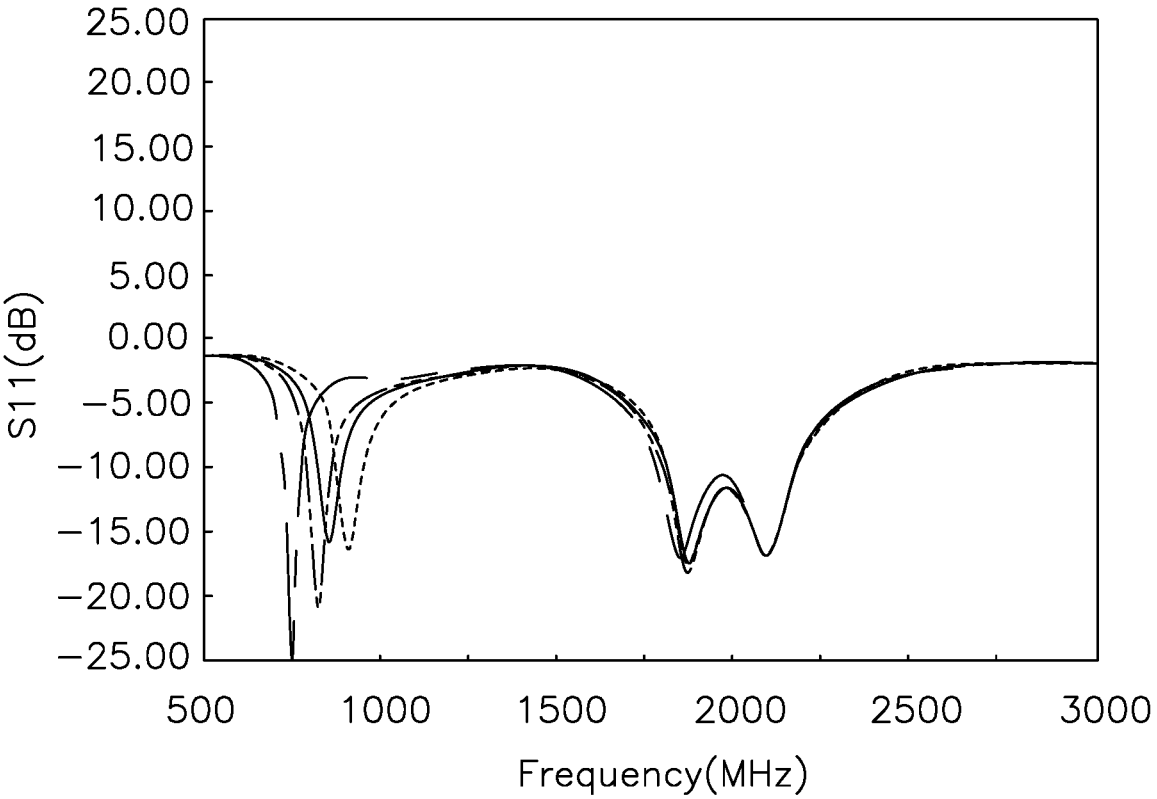
FIG. 7 is a scattering parameter graph when the antenna structure of FIG. 1 works at a low frequency operation mode and a middle frequency operation mode.

FIG. 7 illustrates a scattering parameter graph of the antenna structure 100 when the antenna structure 100 works at the LTE-A low frequency operation mode and the LTE-A middle frequency operation mode. When the switching unit 181 of the switching circuit 18 switches to different switching elements 183 (for example four different switching elements 183), since each switching element 183 has a different impedance, an operating frequency band of the LTE-A low frequency band of the antenna structure 100 can be adjusted thereby. Through adjusting an inductance of the inductor L, frequencies of the LTE-A middle frequency band of the antenna structure 100 can be effectively adjusted.

Figure 8:
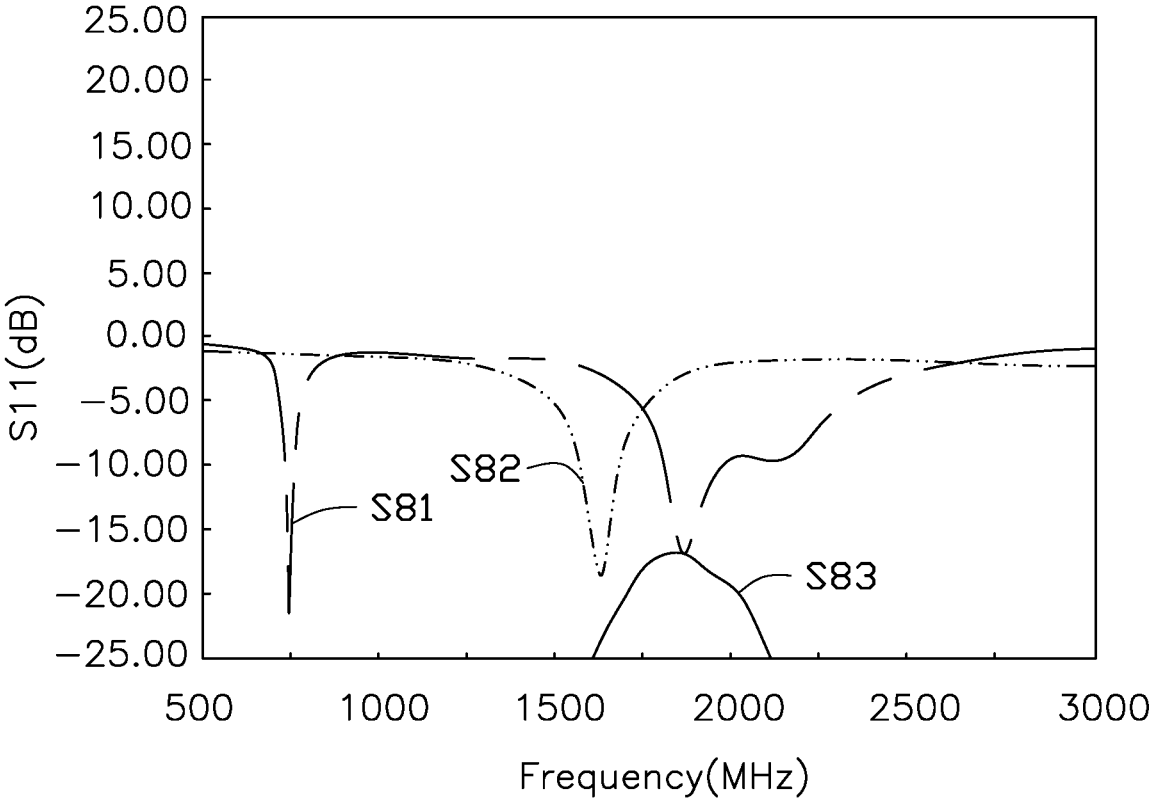
FIG. 8 is a scattering parameter graph when the antenna structure of FIG. 1 works at the low frequency operation mode, a Global Positioning System (GPS) operation mode, and the middle frequency operation mode.

FIG. 8 illustrates a scattering parameter graph of the antenna structure 100 when the antenna structure 100 works at the LTE-A low frequency operation mode, the LTE-A middle frequency operation mode, and the GPS operation mode. Curve 81 illustrates a scattering parameter when the antenna structure 100 works at the LTE-A low frequency operation mode and the LTE-A middle frequency operation mode. Curve 82 illustrates a scattering parameter when the antenna structure 100 works at the GPS operation mode. Curve 83 illustrates an isolation between the first radiating portion H1 and the second radiating portion H2 when the antenna structure 100 works at the LTE-A low frequency operation mode, the LTE-A middle frequency operation mode, and the GPS operation mode.

Figure 9:
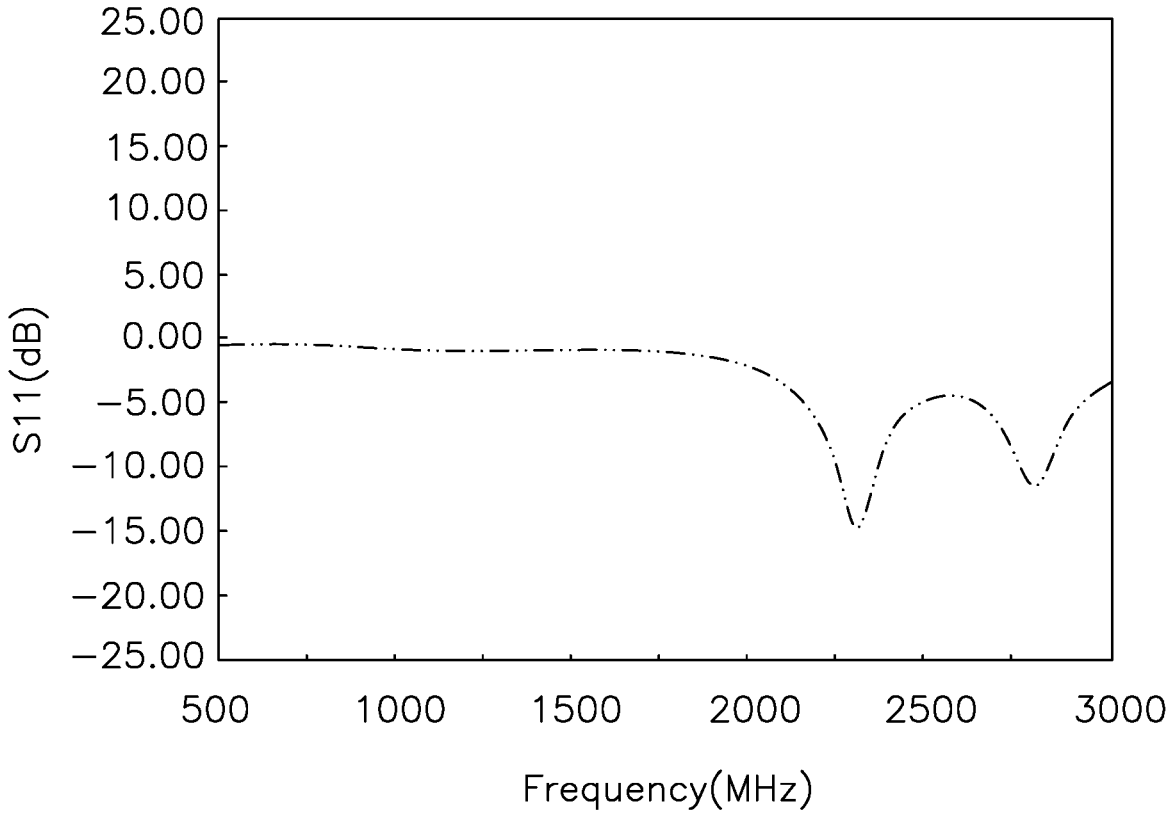
FIG. 9 is a scattering parameter graph when the antenna structure of FIG. 1 works at a high frequency operation mode.
Figure 10:
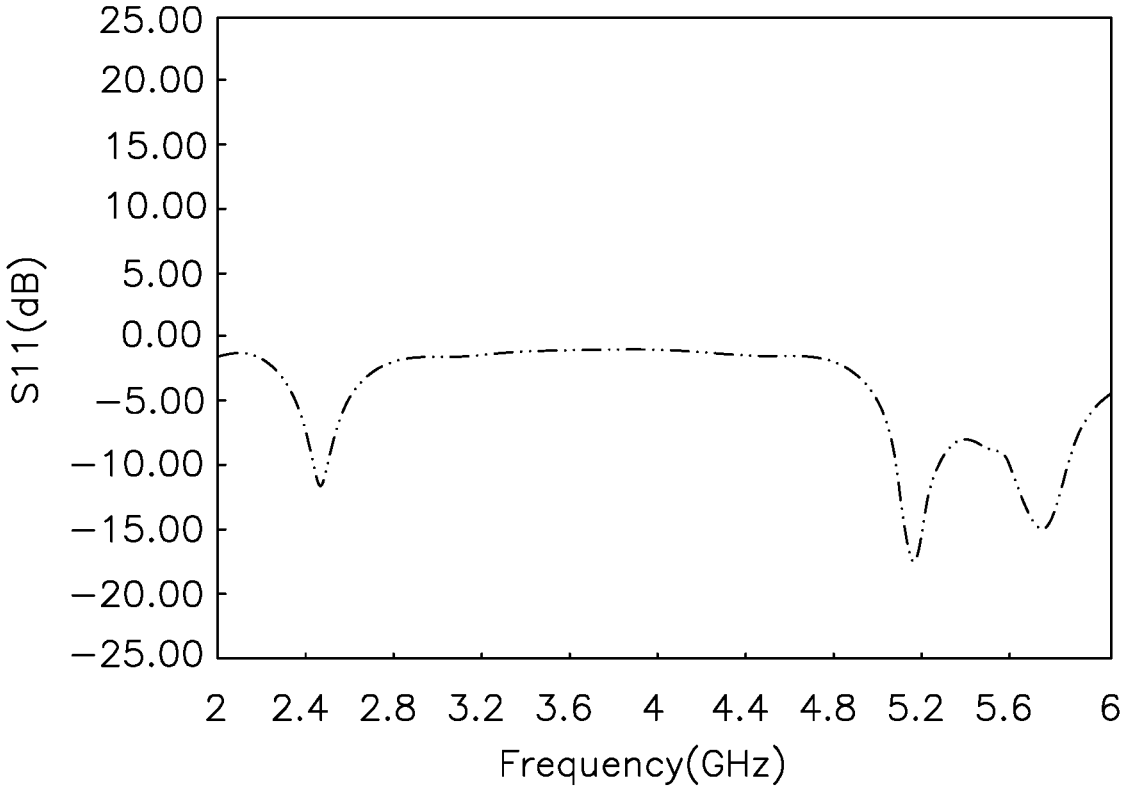
FIG. 10 is a scattering parameter graph when the antenna structure of FIG. 1 works at a WIFI 2.4 GHz operation mode and a WIFI 5 GHz operation mode.

FIG. 9 illustrates a scattering parameter graph of the antenna structure 100 when the antenna structure 100 works at the LTE-A high frequency operation mode. FIG. 10 illustrates a scattering parameter graph of the antenna structure 100 when the antenna structure 100 works at the WIFI 2.4 GHz operation mode and the WIFI 5 GHz operation mode.

Figure 11:
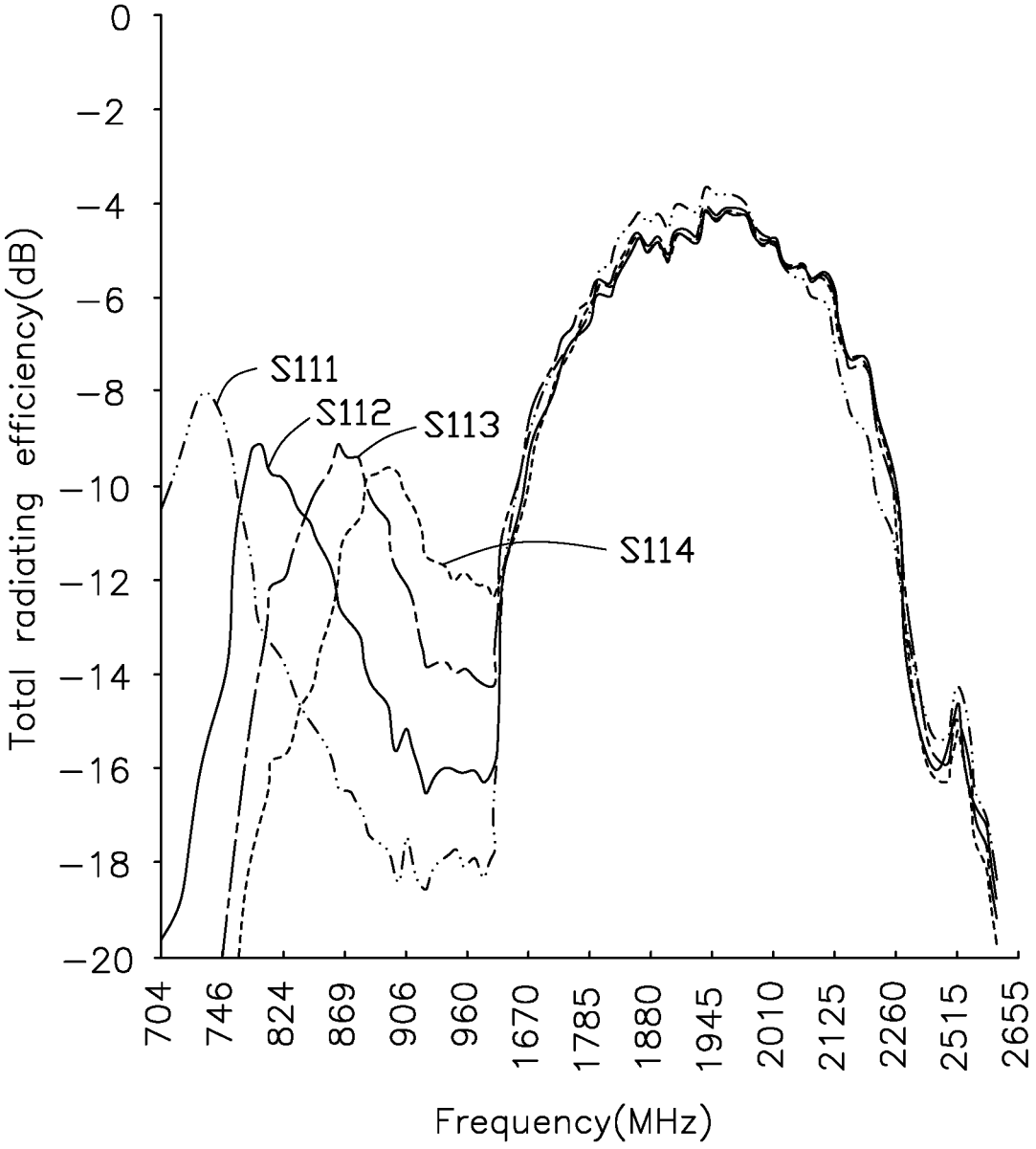
FIG. 11 is a total radiating efficiency graph of when the antenna structure of FIG. 1 works at the low frequency operation mode and the middle frequency operation mode.

FIG. 11 illustrates a total radiating efficiency of the antenna structure 100 when the antenna structure 100 works at the LTE-A low frequency operation mode and the LTE-A middle frequency operation mode. Curve S111 illustrates a total radiating efficiency when the switching unit 181 switches to a switching element 183 having an inductance value of about 27 nH and the antenna structure 100 works at a frequency band of LTE-A band17 (704-746 MHz). Curve S112 illustrates a total radiating efficiency when the switching unit 181 switches to a switching element 183 having an inductance value of about 15 nH and the antenna structure 100 works at a frequency band of LTE-A band20 (791-862 MHz). Curve S113 illustrates a total radiating efficiency when the switching unit 181 switches to a switching element 183 having an inductance value of about 9.1 nH and the antenna structure 100 works at a frequency band of LTE-A band5 (824-894 MHz). Curve S114 illustrates a total radiating efficiency when the switching unit 181 switches to a switching element 183 having an inductance value of about 6.2 nH and the antenna structure 100 works at a frequency band of LTE-A band8 (880-960 MHz).

Through switching the switching unit 181, the low frequency band of the antenna structure 100 can cover 704-960 MHz. In addition, when the antenna structure 100 operates in the LTE-A band 17/20/5/8 and the LTE-A middle frequency band (1710-2170 MHz), the average total radiating efficiency of the antenna structure 100 is about −8.1 dB, −8.8 dB, −9.0 dB, −9.3 dB, and −5.3 dB, respectively.

Figure 12:
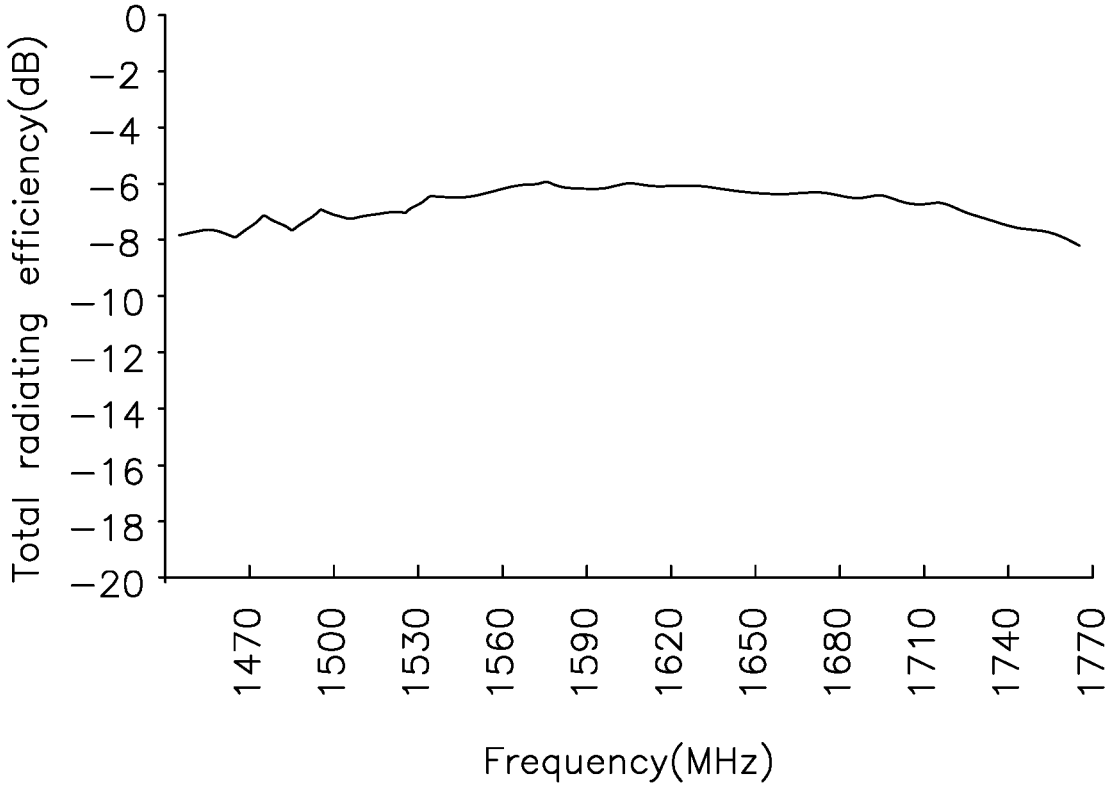
FIG. 12 is a total radiating efficiency graph of when the antenna structure of FIG. 1 works at the GPS operation mode.
Figure 13:
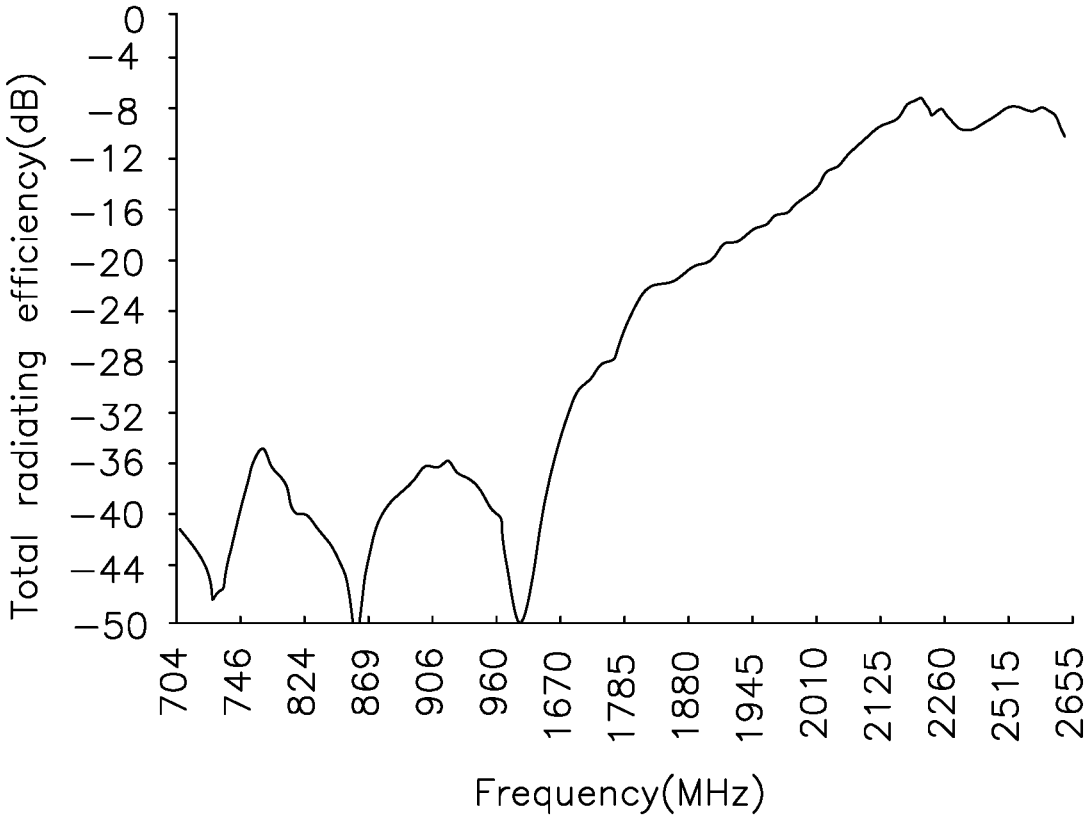
FIG. 13 is a total radiating efficiency graph of when the antenna structure of FIG. 1 works at the high frequency operation mode.
Figure 14:
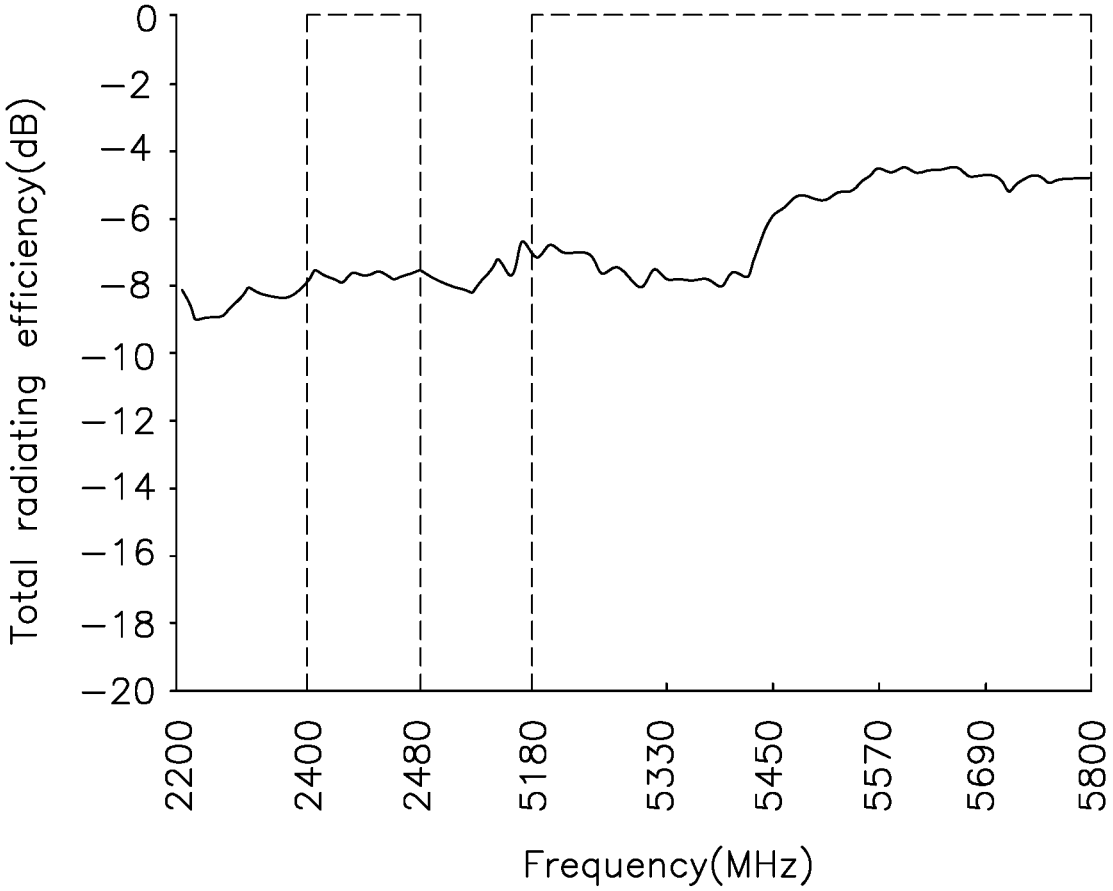
FIG. 14 is a total radiating efficiency graph of when the antenna structure of FIG. 1 works at the WIFI 2.4 GHz operation mode and the WIFI 5 GHz operation mode.

FIG. 12 illustrates a total radiating efficiency of the antenna structure 100 when the antenna structure 100 works at the GPS operation mode. FIG. 13 illustrates a total radiating efficiency of the antenna structure 100 when the antenna structure 100 works at the LTE-A high frequency operation mode. FIG. 14 illustrates a total radiating efficiency of the antenna structure 100 when the antenna structure 100 works at the WIFI 2.4 GHz operation mode and the WIFI 5 GHz operation mode.

When the antenna structure 100 works at the GPS operation mode, an average total radiation efficiency of the antenna structure 100 is about −6.1 dB. When the antenna structure 100 works at the LTE-A high frequency operation mode, an average total radiation efficiency of the antenna structure 100 is about −8.4 dB. When the antenna structure 100 works at the WIFI 2.4 GHz operation mode, an average total radiation efficiency of the antenna structure 100 is about −7.6 dB. When the antenna structure 100 works at the WIFI 5 GHz operation mode, an average total radiation efficiency of the antenna structure 100 is about −6.0 dB.

Referring to FIG. 7 to FIG. 14, the working frequency band of the antenna structure 100 can cover 704-960 MHz and 1710-2690 MHz, and then can be applied to a GSM Quad-band, a UMTS Band frequency band, and LTE-A bands 700/850/900/1800/1900/2100/2300/2500. In addition, the antenna structure 100 can also work at the GPS frequency band and the WIFI 2.4 GHz/5 GHz frequency band. That is, the antenna structure 100 can cover the LTE-A low, middle, and high frequency bands, the GPS frequency band, and the WIFI 2.4 GHz/5 GHz frequency band. When the antenna structure 100 operates in the above frequency bands, the working frequency of the antenna structure 100 can meet the design requirements of the antenna and have a good radiation efficiency.

As described above, the antenna structure 100 defines the first gap 119 and the groove 122. Then a first radiating portion H1 can be divided from the side frame 113. The antenna structure 100 includes the third radiator 17. The first radiating portion H1 activates a first operation mode and a second operation mode to generate radiation signals in LTE-A low and middle frequency bands. The third radiator 17 activates a sixth operation mode to generate radiation signals in LTE-A high frequency band. Then the wireless communication device 200 can use carrier aggregation (CA) technology of LTE-A to receive or send wireless signals at multiple frequency bands simultaneously. In detail, the wireless communication device 200 can use the CA technology and use the first radiating portion H1 and the third radiator 17 to receive or send wireless signals at multiple frequency bands simultaneously, that is, can realize 3CA simultaneously.

As described above, the antenna structure 100 includes the housing 11. The slot 118, the first gap 119, the second gap 121, and the groove 122 of the housing 11 are all defined on the front frame 111 and the side frame 113 instead of on the backboard 112. Then only the front frame 111, the side frame 113, and the corresponding inner radiators (i.e., the first radiator 13, the second radiator 15, and the third radiator 17) may cooperatively form corresponding LTE-A Low, middle and high frequency antennas, GPS antenna, and WIFI 2.4 GHz/5 GHz antenna, which covers a wide band. In addition, the backboard 112 forms an all-metal structure. That is, the backboard 112 does not define any other slot and/or gap and has a good structural integrity and an aesthetic quality.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing comprising a first radiating portion and a second radiating portion;

a first feed source, the first feed source electrically connected to the first radiating portion, the first feed source feeding current to the first radiating portion and the first radiating portion activating a first operation mode and a second operation mode for generating radiation signals in a first frequency band and a second frequency band;

a second feed source, the second feed source electrically connected to the second radiating portion, the second feed source feeding current to the second radiating portion and the second radiating portion activating a third operation mode for generating radiation signals in a third frequency band;

a first radiator, the first radiator positioned in the housing;

a third feed source, the third feed source electrically connected to the first radiator, the third feed source feeding current to the first radiator and the first radiator activating a fourth operation mode for generating radiation signals in a fourth frequency band;

a second radiator, the second radiator positioned in the housing and spaced apart from the first radiator, the current from the first radiator being coupled to the second radiator and the second radiator activating a fifth operation mode for generating radiation signals in a fifth frequency band;

a third radiator, the third radiator positioned in the housing; and a fourth feed source, the fourth feed source electrically connected to the third radiator, the fourth feed source feeding current to the third radiator and the third radiator activating a sixth operation mode for generating radiation signals in a sixth frequency band;

wherein frequencies of the fifth frequency band are higher than frequencies of the sixth frequency band and the fourth frequency band, the frequencies of the sixth frequency band and the fourth frequency band are higher than frequencies of the second frequency band, the frequencies of the second frequency band are higher than frequencies of the third frequency band, and the frequencies of the third frequency band are higher than frequencies of the first frequency band.

2. The antenna structure of claim 1, wherein the first radiating portion and the third radiator are both diversity antennas, the second radiating portion is a Global Positioning System (GPS) antenna, the first radiator is a WIFI 2.4 GHz antenna, and the second radiator is a WIFI 5 GHz antenna; wherein the first operation mode is a Long Term Evolution Advanced (LTE-A) low frequency operation mode, the second operation mode is an LTE-A middle frequency operation mode, the third operation mode is a GPS operation mode, the fourth operation mode is a WIFI 2.4 GHz operation mode, the fifth operation mode is a WIFI 5 GHz operation mode, and the sixth operation mode is an LTE-A high frequency operation mode.

3. The antenna structure of claim 1, wherein the housing at least comprises a front frame, a backboard, and a side frame, the side frame is positioned between the front frame and the backboard, the side frame defines a slot, the front frame defines a first gap, a second gap, and a groove; wherein the first gap, the second gap, and the groove all communicate with the slot and extend across the front frame; and wherein the first radiating portion and the second radiating portion are divided from the housing by the slot, the first gap, the second gap, and the groove.

4. The antenna structure of claim 3, wherein the side frame comprises an end portion, a first side portion, and a second side portion, the first side portion and the second side portion connect to two ends of the end portion; wherein the slot is defined on at least the end portion, the first gap is defined on the first side portion, the second gap is defined on the second side portion, and the groove is defined on the end portion; wherein a first portion of the front frame between the first gap and the groove forms the first radiating portion, a second portion of the front frame between the second gap and the groove forms the second radiating portion, the first radiator and the second radiator are positioned between the first feed source and the first side portion, and the third radiator is positioned adjacent to the second side portion.

5. The antenna structure of claim 4, wherein the first feed source is electrically connected to the first radiating portion, a first portion of the front frame extending from the first feed source to the first gap forms a first branch, and a second portion of the front frame extending from the first feed source to the groove forms a second branch; wherein the first branch activates the first operation mode and the second branch activates the second operation mode.

6. The antenna structure of claim 5, further comprising a first ground portion and a second ground portion, wherein one end of the first ground portion is electrically connected to the first branch and another end of the first ground portion is grounded, one end of the second ground portion is electrically connected to the second branch and another end of the second ground portion is grounded; wherein the first feed source, the first branch, and the first ground portion cooperatively form a first inverted-F antenna, the first feed source, the second branch, and the second ground portion cooperatively form a second inverted-F antenna, the second feed source and the second radiating portion cooperatively form a first monopole antenna, the third feed source and the first radiator cooperatively form a second monopole antenna, the third feed source, the first radiator, and the second radiator cooperatively form a coupling-feed-in antenna, the fourth feed source and the third radiator cooperatively form a third inverted-F antenna.

7. The antenna structure of claim 6, further comprising a switching circuit, wherein the switching circuit comprises a switching unit and a plurality of switching elements, the switching unit is electrically connected to the first ground portion and is electrically connected to the first branch through the first ground portion, the switching elements are connected in parallel to each other, one end of each switching element is electrically connected to the switching unit, and the other end of each switching element is grounded; wherein through controlling the switching unit to switch, the switching unit is switched to different switching elements and the frequencies of the first frequency band are adjusted.

8. The antenna structure of claim 6, further comprising a matching circuit, wherein the matching circuit comprises an inductor, one end of the inductor is electrically connected to the second ground portion and is electrically connected to the second branch through the second ground portion, another end of the inductor is grounded; wherein the inductor matches or compensates an impedance of the second branch to adjust the frequencies of the second frequency band.

9. The antenna structure of claim 4, wherein the first radiator comprises a first radiating arm, a second radiating arm, a third radiating arm, a fourth radiating arm, a fifth radiating arm, a sixth radiating arm, a seventh radiating arm, and an eighth radiating arm; wherein the first radiating arm is substantially rectangular and is positioned parallel to the first side portion, the second radiating arm is perpendicularly connected to one end of the first radiating arm adjacent to the end portion and extends along a direction parallel to the end portion and towards the second side portion; wherein the third radiating arm is perpendicularly connected to one end of the second radiating arm away from the first radiating arm and extends along a direction parallel to the first side portion and towards the end portion; wherein the fourth radiating arm is perpendicularly connected to one end of the third radiating arm away from the second radiating arm and extends along a direction parallel to the end portion and towards the first side portion; wherein the fifth radiating arm is perpendicularly connected to one end of the fourth radiating arm away from the third radiating arm and extends along a direction parallel to the first side portion and towards the end portion; wherein the sixth radiating arm is perpendicularly connected to one end of the fifth radiating arm away from the fourth radiating arm and extends along a direction parallel to the end portion and towards the first side portion; wherein the seventh radiating arm is perpendicularly connected to one end of the sixth radiating arm away from the fifth radiating arm and extends along a direction parallel to the first side portion and away from the end portion; wherein the eighth radiating arm is perpendicularly connected to one end of the seventh radiating arm away from the sixth radiating arm and extends along a direction parallel to the end portion and towards the first side portion.

10. The antenna structure of claim 9, wherein the second radiator comprises a first parasitic section and a second parasitic section, one end of the first parasitic section is grounded and another end of the first parasitic section extends along a direction parallel to the first side portion and towards the eighth radiating arm; wherein the second parasitic section is perpendicularly connected to one end of the first parasitic section towards the eighth radiating arm and extends along a direction parallel to the eighth radiating arm and towards the third radiating arm until the second parasitic section extends into a space surrounded by the first radiator.

11. The antenna structure of claim 4, wherein the third radiator comprises a feed section, a first connecting section, a second connecting section, a third connecting section, and a ground section, the feed section is positioned parallel to and spaced apart from the second side portion and extends towards the end portion; wherein the first connecting section is perpendicularly connected to one end of the feed section adjacent to the end portion and extends along a direction parallel to the end portion and towards the first side portion until the first connecting section passes over the groove; wherein the second connecting section is perpendicularly connected to one end of the first connecting section away from the feed section and extends along a direction parallel to the second side portion and towards the end portion; wherein the third connecting section is perpendicularly connected to one end of the second connecting section away from the first connecting section and extends along a direction parallel to the end portion and towards the second side portion until the third connecting section passes over the groove and further extends along the direction parallel to the end portion and towards the second side portion; wherein the ground section is spaced apart from and parallel to the feed section, one end of the ground section is perpendicularly connected to one side of the first connecting section and extends along a direction parallel to the feed section and away from the end portion, another end of the ground section is grounded.

12. The antenna structure of claim 1, wherein a wireless communication device uses the first radiating portion and the third radiator to receive or send wireless signals at multiple frequency bands simultaneously through carrier aggregation (CA) technology of LTE-A.

13. A wireless communication device comprising:

an antenna structure, the antenna structure comprising:

a housing, the housing comprising a first radiating portion and a second radiating portion;

a first feed source, the first feed source electrically connected to the first radiating portion, the first feed source feeding current to the first radiating portion and the first radiating portion activating a first operation mode and a second operation mode for generating radiation signals in a first frequency band and a second frequency band;

a second feed source, the second feed source electrically connected to the second radiating portion, the second feed source feeding current to the second radiating portion and the second radiating portion activating a third operation mode for generating radiation signals in a third frequency band;

a first radiator, the first radiator positioned in the housing;

a third feed source, the third feed source electrically connected to the first radiator, the third feed source feeding current to the first radiator and the first radiator activating a fourth operation mode for generating radiation signals in a fourth frequency band;

a second radiator, the second radiator positioned in the housing and spaced apart from the first radiator, the current from the first radiator being coupled to the second radiator and the second radiator activating a fifth operation mode for generating radiation signals in a fifth frequency band;

a third radiator, the third radiator positioned in the housing; and a fourth feed source, the fourth feed source electrically connected to the third radiator, the fourth feed source feeding current to the third radiator and the third radiator activating a sixth operation mode for generating radiation signals in a sixth frequency band;

wherein frequencies of the fifth frequency band are higher than frequencies of the sixth frequency band and the fourth frequency band, the frequencies of the sixth frequency band and the fourth frequency band are higher than frequencies of the second frequency band, the frequencies of the second frequency band are higher than frequencies of the third frequency band, and the frequencies of the third frequency band are higher than frequencies of the first frequency band.

14. The wireless communication device of claim 13, wherein the first radiating portion and the third radiator are both diversity antennas, the second radiating portion is a Global Positioning System (GPS) antenna, the first radiator is a WIFI 2.4 GHz antenna, and the second radiator is a WIFI 5 GHz antenna; wherein the first operation mode is a Long Term Evolution Advanced (LTE-A) low frequency operation mode, the second operation mode is an LTE-A middle frequency operation mode, the third operation mode is a GPS operation mode, the fourth operation mode is a WIFI 2.4 GHz operation mode, the fifth operation mode is a WIFI 5 GHz operation mode, and the sixth operation mode is an LTE-A high frequency operation mode.

15. The wireless communication device of claim 13, wherein the housing at least comprises a front frame, a backboard, and a side frame, the side frame is positioned between the front frame and the backboard, the side frame defines a slot, the front frame defines a first gap, a second gap, and a groove; wherein the first gap, the second gap, and the groove all communicate with the slot and extend across the front frame; and wherein the first radiating portion and the second radiating portion are divided from the housing by the slot first gap, the second gap, and the groove.

16. The wireless communication device of claim 15, wherein the side frame comprises an end portion, a first side portion, and a second side portion, the first side portion and the second side portion connect to two ends of the end portion; wherein the slot is defined on at least the end portion, the first gap is defined on the first side portion, the second gap is defined on the second side portion, and the groove is defined on the end portion; wherein a first portion of the front frame between the first gap and the groove forms the first radiating portion, a second portion of the front frame between the second gap and the groove forms the second radiating portion, the first radiator and the second radiator are positioned between the first feed source and the first side portion, and the third radiator is positioned adjacent to the second side portion.

17. The wireless communication device of claim 16, wherein the first feed source is electrically connected to the first radiating portion, a first portion of the front frame extending from the first feed source to the first gap forms a first branch, and a second portion of the front frame extending from the first feed source to the groove forms a second branch; wherein the first branch activates the first operation mode and the second branch activates the second operation mode.

18. The wireless communication device of claim 17, wherein the antenna structure further comprises a first ground portion and a second ground portion, one end of the first ground portion is electrically connected to the first branch and another end of the first ground portion is grounded, one end of the second ground portion is electrically connected to the second branch and another end of the second ground portion is grounded; wherein the first feed source, the first branch, and the first ground portion cooperatively form a first inverted-F antenna, the first feed source, the second branch, and the second ground portion cooperatively form a second inverted-F antenna, the second feed source and the second radiating portion cooperatively form a first monopole antenna, the third feed source and the first radiator cooperatively form a second monopole antenna, the third feed source, the first radiator, and the second radiator cooperatively form a coupling-feed-in antenna, the fourth feed source and the third radiator cooperatively form a third inverted-F antenna.

19. The wireless communication device of claim 16, wherein the first radiator comprises a first radiating arm, a second radiating arm, a third radiating arm, a fourth radiating arm, a fifth radiating arm, a sixth radiating arm, a seventh radiating arm, and an eighth radiating arm; wherein the first radiating arm is substantially rectangular and is positioned parallel to the first side portion, the second radiating arm is perpendicularly connected to one end of the first radiating arm adjacent to the end portion and extends along a direction parallel to the end portion and towards the second side portion; wherein the third radiating arm is perpendicularly connected to one end of the second radiating arm away from the first radiating arm and extends along a direction parallel to the first side portion and towards the end portion; wherein the fourth radiating arm is perpendicularly connected to one end of the third radiating arm away from the second radiating arm and extends along a direction parallel to the end portion and towards the first side portion; wherein the fifth radiating arm is perpendicularly connected to one end of the fourth radiating arm away from the third radiating arm and extends along a direction parallel to the first side portion and towards the end portion; wherein the sixth radiating arm is perpendicularly connected to one end of the fifth radiating arm away from the fourth radiating arm and extends along a direction parallel to the end portion and towards the first side portion; wherein the seventh radiating arm is perpendicularly connected to one end of the sixth radiating arm away from the fifth radiating arm and extends along a direction parallel to the first side portion and away from the end portion; wherein the eighth radiating arm is perpendicularly connected to one end of the seventh radiating arm away from the sixth radiating arm and extends along a direction parallel to the end portion and towards the first side portion.

20. The wireless communication device of claim 19, wherein the second radiator comprises a first parasitic section and a second parasitic section, one end of the first parasitic section is grounded and another end of the first parasitic section extends along a direction parallel to the first side portion and towards the eighth radiating arm; wherein the second parasitic section is perpendicularly connected to one end of the first parasitic section towards the eighth radiating arm and extends along a direction parallel to the eighth radiating arm and towards the third radiating arm until the second parasitic section extends into a space surrounded by the first radiator; wherein the third radiator comprises a feed section, a first connecting section, a second connecting section, a third connecting section, and a ground section, the feed section is positioned parallel to and spaced apart from the second side portion and extends towards the end portion; wherein the first connecting section is perpendicularly connected to one end of the feed section adjacent to the end portion and extends along a direction parallel to the end portion and towards the first side portion until the first connecting section passes over the groove; wherein the second connecting section is perpendicularly connected to one end of the first connecting section away from the feed section and extends along a direction parallel to the second side portion and towards the end portion; wherein the third connecting section is perpendicularly connected to one end of the second connecting section away from the first connecting section and extends along a direction parallel to the end portion and towards the second side portion until the third connecting section passes over the groove and further extends along the direction parallel to the end portion and towards the second side portion; wherein the ground section is spaced apart from and parallel to the feed section, one end of the ground section is perpendicularly connected to one side of the first connecting section and extends along a direction parallel to the feed section and away from the end portion, another end of the ground section is grounded.

* * * * *